US006662689B1

(12) United States Patent
Voskanyan

(10) Patent No.: US 6,662,689 B1
(45) Date of Patent: Dec. 16, 2003

(54) ADJUSTABLE SOCKET WRENCH

(76) Inventor: Volodya Voskanyan, 7814 Broadleaf Ave., Panorama City, CA (US) 91402

( * ) Notice: Subject to any disclaimer, the term of this patent is extended or adjusted under 35 U.S.C. 154(b) by 0 days.

(21) Appl. No.: 10/141,794

(22) Filed: May 7, 2002

Related U.S. Application Data

(60) Provisional application No. 60/289,122, filed on May 8, 2001.

(51) Int. Cl.[7] ..... B25B 13/16

(52) U.S. Cl. ..... 81/163; 81/170

(58) Field of Search ..... 81/163, 165, 167, 81/170, 129; 279/66, 10, 60, 71, 110, 114

(56) References Cited

U.S. PATENT DOCUMENTS

| | | | | | |
|---|---|---|---|---|---|
| 601,134 | A | | 3/1898 | Funk | |
| 872,633 | A | * | 12/1907 | Anspach | 81/62 |
| 1,035,886 | A | * | 8/1912 | Markus | 81/57.29 |
| 1,456,358 | A | * | 5/1923 | Broxton | 81/165 |
| 2,743,641 | A | * | 5/1956 | Stricklett et al. | 81/163 |
| 2,801,562 | A | * | 8/1957 | Stricklett et al. | 81/163 |
| 3,253,486 | A | * | 5/1966 | Beck | 81/163 |
| 4,136,588 | A | * | 1/1979 | Roder | 81/165 |
| 4,149,820 | A | | 4/1979 | Newlin | |
| 4,864,901 | A | * | 9/1989 | le Duc | 81/163 |
| 4,898,052 | A | * | 2/1990 | Kang | 81/57.43 |
| 4,967,625 | A | * | 11/1990 | Kolari et al. | 81/170 |
| 5,626,062 | A | | 5/1997 | Colvin | |
| 5,732,992 | A | * | 3/1998 | Mauldin | 294/119.1 |
| 6,341,544 | B1 | * | 1/2002 | Falzone | 81/128 |

* cited by examiner

*Primary Examiner*—Joseph J. Hail, III
*Assistant Examiner*—David B. Thomas
(74) *Attorney, Agent, or Firm*—Matthew J. Peirce

(57) ABSTRACT

The present invention concerns that of a new and improved adjustable socket that would attach to a ratchet wrench, a drill, or a driver. The adjustable socket would have two socket portions that would each be mounted on a threaded rod. The threaded rod would be located within a central channel and would be connected to adjustment means. Half of the threaded rod would have right-handed thread, while the other half of the threaded rod would have left-handed thread. The adjustment means would allow the two socket portions to be moved closer to or further away from each other for adjustment for different size bolts to be tightened or loosened. A top-mounted square hole would allow a ratchet end to be attached to the adjustable socket.

3 Claims, 6 Drawing Sheets

ADJUSTABLE SOCKET WRENCH

This application claims the benefit of Provisional application Ser. No. 60,289,122 filed May 8, 2001.

I. BACKGROUND OF THE INVENTION

The present invention is that of a new and improved adjustable socket wrench that would attach to a ratchet wrench, a drill, or a driver.

II. DESCRIPTION OF THE PRIOR ART

U.S. Pat. No. 5,626,062, issued to Colvin, discloses a combination socket and ratchet wrench.

U.S. Pat. No. 4,149,820, issued to Newlin, discloses a ratchet tool with a socket attachment.

U.S. Pat. No. 601,134, issued to Funk, discloses a ratchet wrench capable of rotating a plurality of nuts of various sizes.

III. SUMMARY OF THE INVENTION

The present invention concerns that of a new and improved adjustable socket wrench that would attach to a ratchet wrench, a drill, or a driver. The adjustable socket wrench would have two socket portions that would each be mounted on a threaded rod. The threaded rod would be located within a central channel and would be connected to adjustment means. Half of the threaded rod would have right-handed thread, while the other half of the threaded rod would have left-handed thread. The adjustment means would allow the two socket portions to be moved closer to or further away from each other for adjustment for different size bolts to be tightened or loosened. A top-mounted square hole would allow a ratchet end to be attached to the adjustable socket wrench.

There has thus been outlined, rather broadly, the more important features of a adjustable socket wrench that the detailed description thereof that follows may be better understood and in order that the present contribution to the art may be better appreciated. There are, of course, additional features of the adjustable socket wrench that will be described hereinafter and which will form the subject matter of the claims appended hereto.

In this respect, before explaining at least one embodiment of the adjustable socket wrench in detail, it is to be understood that the adjustable socket wrench is not limited in its application to the details of construction and to the arrangements of the components set forth in the following description or illustrated in the drawings. The adjustable socket wrench is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present adjustable socket wrench. It is important, therefore, that the claims be regarded as including such equivalent constructions insofar as they do not depart from the spirit and scope of the present invention.

It is therefore an object of the present invention to provide an adjustable socket wrench which has all of the advantages of the prior art and none of the disadvantages.

It is another object of the present invention to provide an adjustable socket wrench which may be easily and efficiently manufactured and marketed.

It is another object of the present invention to provide an adjustable socket wrench which is of durable and reliable construction.

It is yet another object of the present invention to provide an adjustable socket wrench which is economically affordable and available for relevant purchasing government entities.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
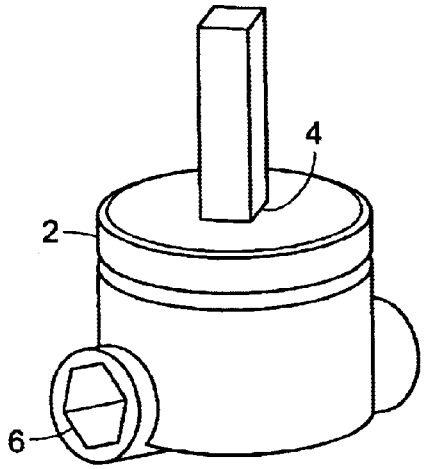
FIG. 1 shows a perspective view of the upper section of the present invention.
Figure 2:
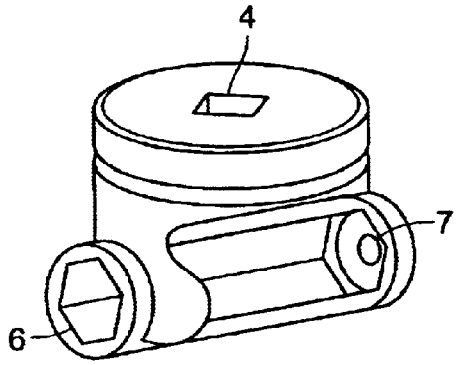
FIG. 2 shows a cutaway view of the upper section of the present invention.

FIG. 1 shows a perspective view of upper section 2 of the first preferred embodiment of the present invention, while FIG. 2 shows a cutaway view of upper section 2 of the first preferred embodiment of the present invention. Upper section 2 has a top-mounted square hole 4 which would allow a ratchet wrench to be inserted into square hole 4. Upper section 2 is cylindrical in shape.

To the bottom of upper section 2 is attached center tube 6, with center tube being having a hexagonal cross-sectional diameter for most of its length. Center tube 6 has two ends, a first end and a second end, and only at the second end of center tube 6 is there a small length of center tube 6 that has a circular cross-sectional diameter. Otherwise, the rest of center tube 6 is hexagonal in nature. The first end of center tube is open, while the second end of center tube 6 is primarily closed, except for small hole 7 which is centrally located at the second end of center tube 6.

Figure 3:
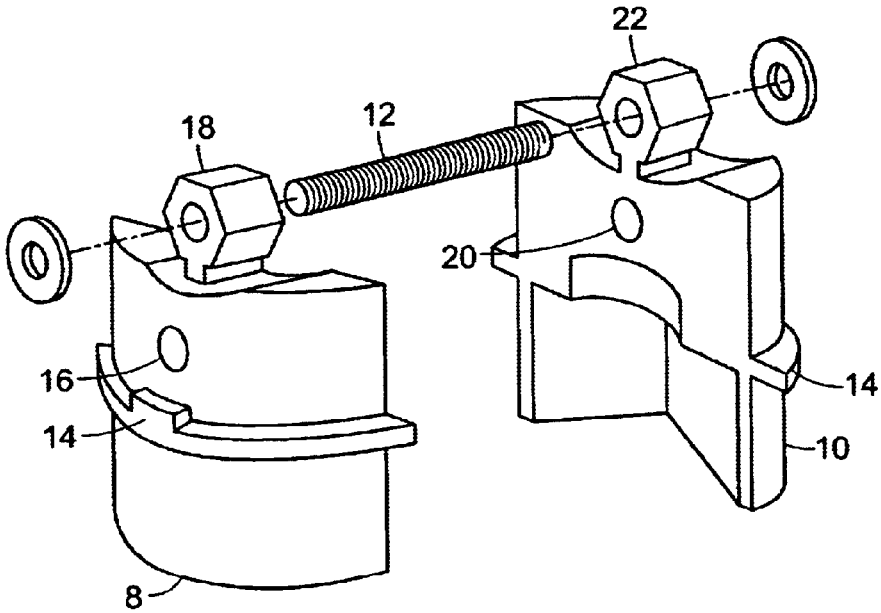
FIG. 3 shows a perspective view of the left socket, the fight socket, and the threaded rod of the present invention.

FIG. 3 shows a perspective view of left socket 8, right socket 10, and threaded rod 12 of the first preferred embodiment of the present invention. Left socket 8 and fight socket 10 are essentially mirror images of one another. Left socket 8 and right socket 10 are essentially one-third (⅓)-cylindrical in shape. Left socket 8, for descriptive purposes, can generally be divided into two portions: an upper half and a lower half. The lower half of left socket 8 is partially hollowed out and has two inner sides, a first inner side and a second inner side. The first inner side meets the second inner side at approximately a one-hundred twenty (120) degree angle, while both the first inner side and the second inner side of the lower half of left socket 8 meet the edge of the left socket 8 at a thirty (30) degree angle.

The upper half of left socket 8 is separated from the lower half of left socket 8 by a ridge 14 and has a centrally mounted hole 16 running through left socket 8. In addition, left socket 8 also has a top-mounted socket piece 18 which is internally threaded with left-handed thread.

Right socket 10, for descriptive purposes, can generally be divided into two portions: an upper half and a lower half. The lower half of right socket 10 is partially hollowed out and has two inner sides, a first inner side and a second inner side. The first inner side meets the second inner side at approximately a one-hundred twenty (120) degree angle, while both the first inner side and the second inner side of the lower half of right socket 10 meet the edge of the right socket 10 at a thirty (30) degree angle.

The upper half of right socket 10 is separated from the lower half of right socket 10 by a ridge 14 and has a centrally mounted hole 20 running through right socket 10. In addition, fight socket 10 also a top-mounted socket piece 22 which is internally threaded with right-handed thread.

Threaded rod 12 is threaded along its entire length and has two ends, a first end and a second end. For the one-half portion of threaded rod 12 that includes the first end of threaded rod 12, the threading would be right-handed thread. For the one-half portion of threaded rod 12 that includes the second end of threaded rod 12, the threading would be left-handed thread.

Figure 4:
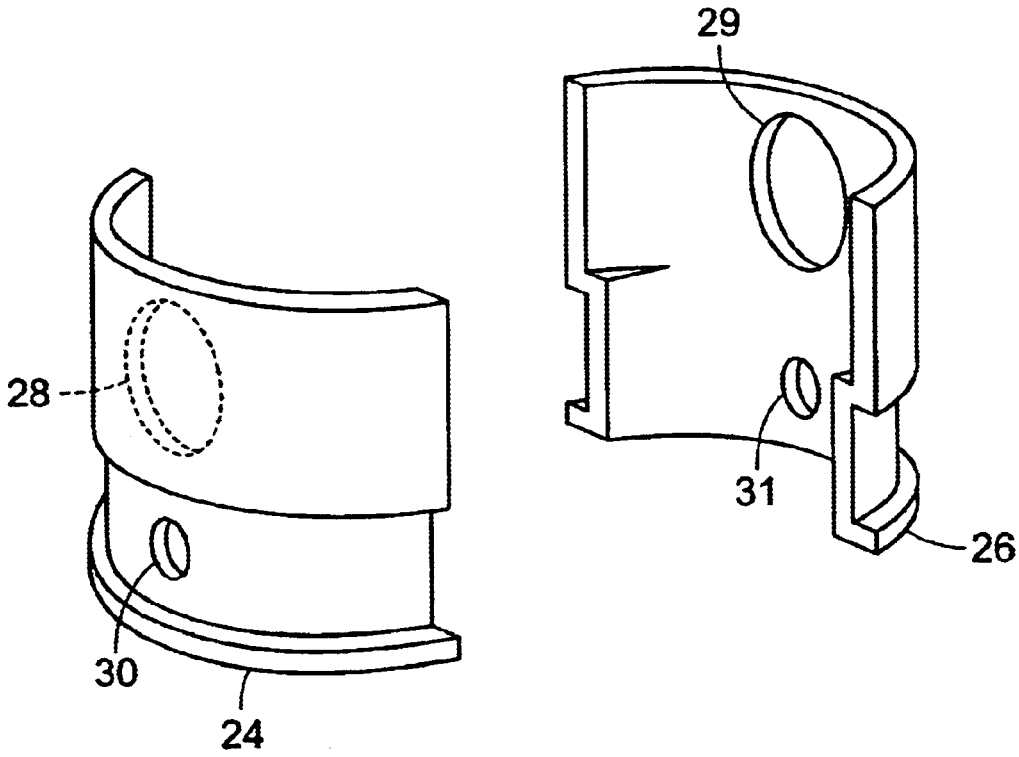
FIG. 4 shows a perspective view of the left cover and the right cover of the present invention.

FIG. 4 shows a perspective view of left cover 24 and right cover 26 of the first preferred embodiment of the present invention. Left cover 24 is designed to be placed over the rounded outer surface of left socket 8, while right cover 26 is designed to be placed over the rounded outer surface of fight socket 10.

Left cover 24 is rounded and is divided into two sections, an upper half and a lower half. Left cover 24 is in the shape of approximately a half-circle. The upper half of left cover 24 is designed to be placed over the upper half of left socket 8, while the lower half of left cover 24 is designed to be placed over the lower half of left socket 8. The inner surface of the upper half of left cover 24 has a hollowed-out hole 28 located approximately at the midpoint of the upper half of left cover 24, although hole 28 does not travel entirely through to the outer surface of left cover 24. In addition, the lower half of left cover 24 has a hole 30 located approximately at the midpoint of the lower half of left cover 24.

Right cover 26 is rounded and is divided into two sections, an upper half and a lower half. Right cover 26 is in the shape of approximately a half-circle. The upper half of fight cover 26 is designed to be placed over the upper half of fight socket 10, while the lower half of fight cover 26 is designed to be placed over the lower half of right socket 10. The inner surface of the upper half of fight cover 26 has a hole 29 located approximately at the midpoint of the upper half of fight cover 26. In addition, the lower half of fight cover 26 has a hole 31 located approximately at the midpoint of the lower half of fight cover 26, with hole 31 being threaded.

Figure 5:
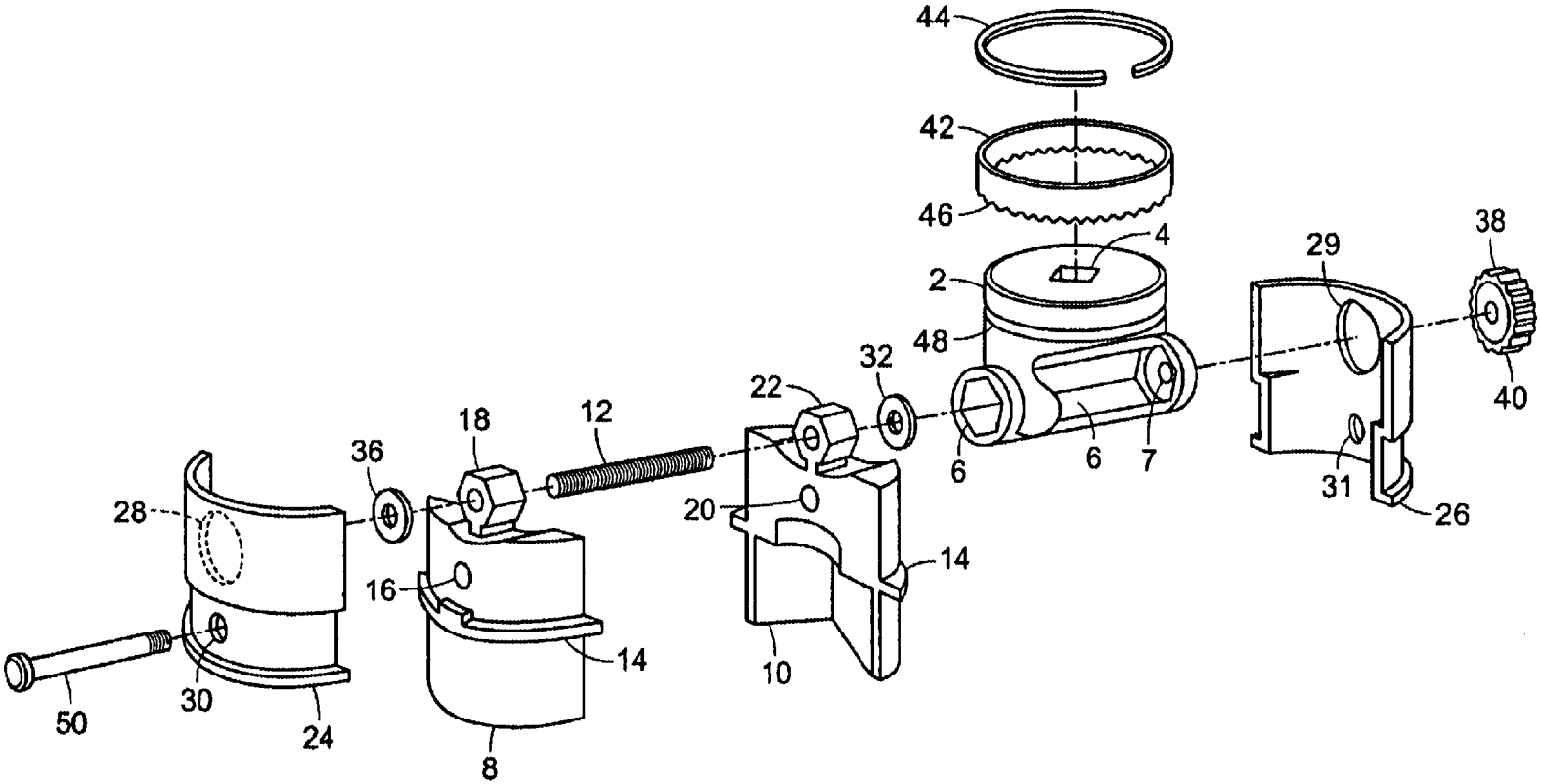
FIG. 5 shows a perspective view of all the parts of the present invention as they would be placed together.

FIG. 5 shows a perspective view of all the parts of the first preferred embodiment of the present invention as they would be placed together. First, the first end of threaded rod 12 would be inserted through and screwed into the hole on the socket piece 22 of right socket 10. Then, washer 32 would be screwed onto the first end of the threaded rod 12 until it would be flush with socket piece 22. After this, socket piece 22 on fight socket 10 would be inserted into the first end of center tube 6 of upper section 2 and then slid all the way down center tube 6 to near the second end of center tube 6. Once this would occur, the first end of threaded rod 12 would be sticking out of hole 7 on center tube 6.

The next step would be to insert socket piece 18 of the left socket 8 into the first end of center tube 6 of upper section 2 and then slide it all the way down center tube 6 until the second end of threaded rod 12 would make contact with the socket piece 18 of left socket 8. At this time, the second end of threaded rod 12 would be threaded through the hole on socket piece 18 of left socket 8. To the second end of threaded rod 12 that would be sticking out of the other end of left socket 8 would be attached washer 36, which would have left-handed thread. Washer 36 would be screwed onto the second end of threaded rod 12 until it would be flush with left socket 8.

The next step would be for a user to place left cover 24 over the first end of center tube 6. Hollowed-out hole 28 is designed to be directly over the first end of center tube 6, effectively capping it off. A user would then take right cover 26 and cover the other half of upper section 2, with the second end of center tube 6 being inserted through hole 29.

To the first end of threaded rod 12 sticking out of hole 7 on center tube 6 would be attached adjustment knob 38. Adjustment knob 38 would have a plurality of angled teeth 40, with the angled teeth 40 being attached at a forty-five (45) degree angle. Adjustment knob 38 would be fixedly attached to the first end of threaded rod 12, causing threaded rod 12 to rotate when adjustment knob 38 would rotate.

To the top of upper section would be attached adjustment knob 42. Adjustment knob 42 would be kept in place by O-ring 44 and would have a plurality of downward facing angled teeth 46 that would be attached a forty-five (45) degree angle. When placed on ridge 48 on upper section 2, the teeth 46 on adjustment knob 42 would be designed are designed to interlock with each other, causing adjustment knob 38 to turn when adjustment knob 42 is turned.

When the present invention is fully functional, left cover 24, fight cover 26, and upper section 2 are designed to be immobile when the present invention is in use. The turn of adjustment knob 42 causes adjustment knob 38 to turn, causing threaded rod 12 to rotate. Because of the difference methods of attachment for the two sockets, both sockets will either go in an inward direction or an outward direction upon the turning of adjustment knobs 38 and 42.

Once all the parts would be attached, shaft 50 would inserted through holes 30, 16, 20, and 31, in that order. The tip of shaft 50 would be threaded, along with hole 31. The threaded nature of the tip of shaft 50 and hole 31 would allow shaft 50 to be removably attached to hole 31 without the need for a bolt or nut, allowing shaft 50 to effectively secure the parts of the present invention shut.

Figure 6:
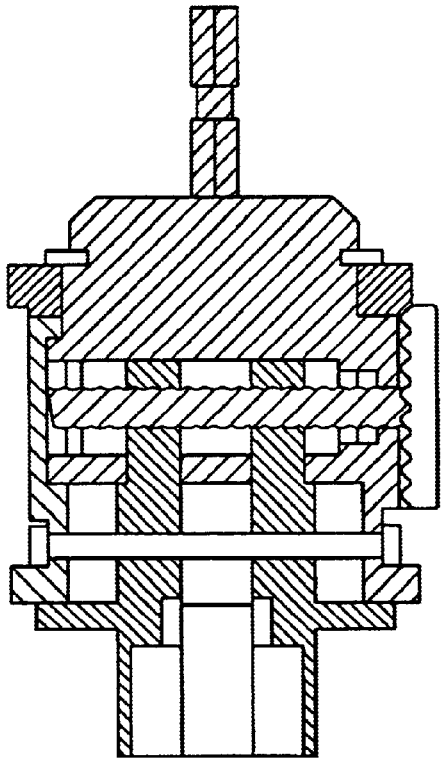
FIG. 6 is a side cutaway view of the present invention as it would be seen with all the parts fully placed together and the invention in a functional manner.

FIG. 6 is a side cutaway view of the first preferred embodiment of the present invention as it would be seen with all the parts fully placed together and the invention in a functional manner.

Figure 7:
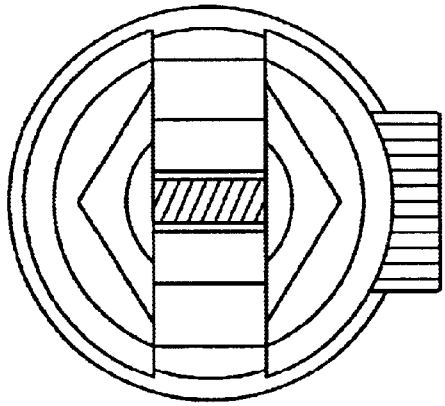
FIG. 7 is a bottom view of the present invention, showing the two sockets of the present invention slightly drawn open.

FIG. 7 is a bottom view of the first preferred embodiment of the present invention, showing the two sockets of the present invention slightly drawn open.

In a variation of the first preferred embodiment, two separate shafts 50 would be used to hold the various parts of the present invention together once it would be installed as a whole. In this embodiment, the series of holes designed for each particular shaft 40 would not directly go through the center of the parts, but rather, would be parallel to one another when being inserted through the various parts of the present invention.

Figure 8:
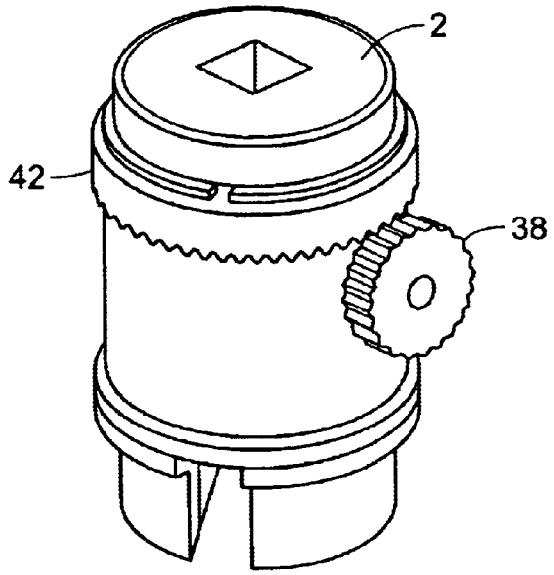
FIG. 8 shows a perspective view of the first preferred embodiment of the present invention.

FIG. 8 shows a perspective view of the first preferred embodiment of the present invention, fully assembled.

Figure 9:
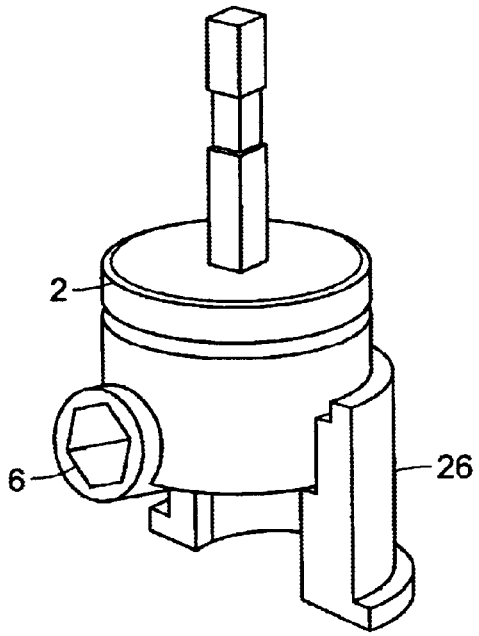
FIG. 9 shows a perspective view of various parts of the second preferred embodiment of the present invention.

FIG. 9 shows a perspective view of various parts of the second preferred embodiment of the present invention. In this embodiment, upper section 2 is shown with attached right cover 26. In this second preferred embodiment, right cover 26 and upper section 2 would, in effect, be one piece.

In this embodiment, adjustment knob 38 would be on the outside of center tube 6 immediately adjacent to the first end of center tube 6. Unlike the first preferred embodiment, however, adjustment knob 38 would not extend through left cover 24—it would be located within left cover 24 and there would be hollowed-out hole 28. The hole 28 does not travel entirely through to the outer surface of left cover 24. The second end of center tube 6 is closed and there would be no hole 7. On fight cover there would be no hole 29.

Figure 10:
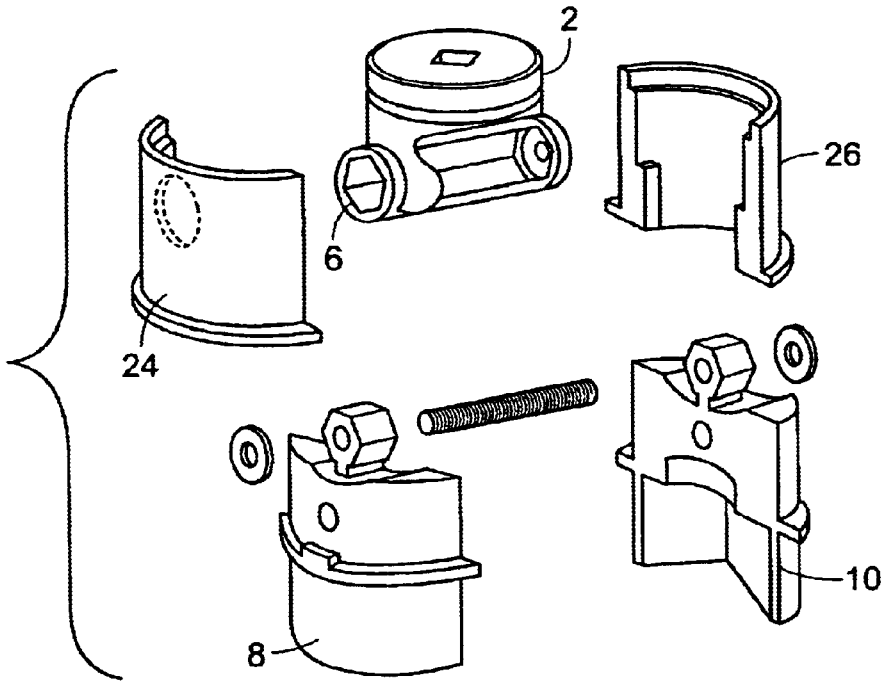
FIG. 10 shows a perspective view of the upper section and fight cover of the second preferred embodiment after they have been pulled apart.

FIG. 10 shows a perspective view of upper section 2 and right cover 26 of the second preferred embodiment after they have been pulled apart. In addition to the previous description of the second preferred embodiment, this embodiment is notably different from the first preferred embodiment because there is no shaft 50 to be inserted through various parts of this embodiment. Therefore, left cover 24 would not have hole 30, left socket 8 would not have hole 16, right socket 10 would not have hole 20, and right cover 26 would not have hole 31.

Figure 11:
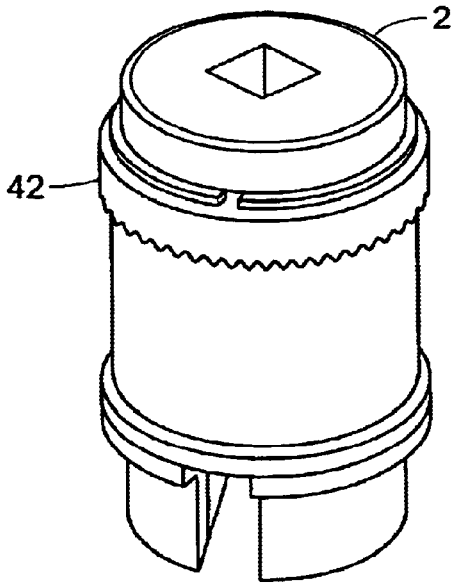
FIG. 11 shows a perspective view of the second preferred embodiment of the present invention.

FIG. 11 shows a perspective view of the second preferred embodiment of the present invention. One markable difference between the first preferred embodiment and the second preferred embodiment is that in the second preferred embodiment, the teeth 40 on adjustment knob 38 and the teeth 46 on adjustment knob 42 are not visible. Teeth 40 of adjustment knob 38, however, still are in immediate contact with the teeth 46 on adjustment knob 42 and function in the same way as present in the same as in the first preferred embodiment.

What I claim as my invention is:

1. An adjustable socket ratchet comprising:

(a) a left socket portion having two faces, an outer face and an inner face, the left socket portion having a top and a bottom, the left socket portion also having a ridge attached to the outer face of the left socket portion approximately halfway between the top and the bottom of the left socket portion, the left socket portion also having a two segments, an upper segment and a lower segment, the upper segment being located above the ridge and the lower segment being located below the ridge, the outer face of the left socket portion having a convex shape, the lower segment of the inner face being partially hollowed out and having two inner sides, a first inner side and a second inner side, the first inner side meeting the second inner side at approximately a one-hundred twenty (120) degree angle, the left socket portion also having a hole centrally located on the upper segment of the left socket portion, the hole beginning on the outer face of the upper segment of the left socket portion and ending on the inner face of the upper segment of the left socket portion, (b) a right socket portion having two faces, an outer face and an inner face, the right socket portion having a top and a bottom, the right socket portion also having a ridge attached to the outer face of the right socket portion approximately halfway between the top and the bottom of the right socket portion, the right socket portion also having a two segments, an upper segment and a lower segment, the upper segment being located above the ridge and the lower segment being located below the ridge, the outer face of the right socket portion having a convex shape, the lower segment of the inner face being partially hollowed out and having two inner sides, a first inner side and a second inner side, the first inner side meeting the second inner side at approximately a one-hundred twenty (120) degree angle, the right socket portion also having a hole central located on the upper segment of the right socket portion, the hole beginning on the outer face of the upper segment of the right socket portion and ending on the inner face of the upper segment of the right socket portion, (c) a first nut attached to the top of the upper segment of the left socket portion, the first nut having left-handed thread, (d) a second nut attached to the top of the upper segment of the right socket portion, the second nut having right-handed thread, (e) a threaded rod having two ends, a first end and a second end, the threaded rod having right-handed thread for approximately one-half the length of the threaded rod closest to the first end of threaded rod, the threaded rod having left-handed thread for approximately one-half the length of the threaded rod closest to the second end of threaded rod, the first end of the threaded rod being threadably inserted into the second nut so that a portion of the first end of the threaded rod would extend past the second nut, and the second end of the threaded rod being threadably inserted into the first nut, (f) a left cover, the left cover being rounded and having two sections, an upper half and a lower half, the left cover also having two surfaces, an inner surface and an outer surface, the upper half of the left cover being designed to be placed over the upper half of left socket portion, while the lower half of the left cover would be designed to be placed over the lower half of the left socket portion, the inner surface of the upper half of the left cover having a hollowed-out circular indentation located approximately at the midpoint of the upper half of the left cover, the indentation not being connected to the outer surface the left cover, the left cover further including a hole located approximately at the midpoint of the lower half of the left cover, (g) a right cover, the right cover being rounded and having two sections, an upper half and a lower half, the right cover also having two surfaces, an inner surface and an outer surface, the upper half of the right cover being designed to be placed over the upper half of right socket portion, while the lower half of the right cover would be designed to be placed over the lower half of the right socket portion, the inner surface of the upper half of the right cover having a hollowed-out hole located approximately at the midpoint of the upper half of the right cover, the right cover further including a hole located approximately at the midpoint of the lower half of the right cover, the hole being threaded, (h) an upper section, the upper section being cylindrical in shape, the upper section having two flat surfaces, a top surface and a bottom surface, the upper section having a square hole centrally located on the top surface of the upper section, (i) a horizontal center tube attached to the bottom of the upper section, the center tube having two ends, a first end and a second end, the center tube having a hexagonal cross-sectional diameter for a substantial portion of its length, the first end of the center tube being open, the second end of the center tube being closed except for a small hole centrally located at the second end of center tube, (j) wherein the second nut would be inserted into the first end of the center tube of the upper section and then slid all the way down the center tube near the second end of center tube, wherein the first end of threaded rod would extend out of the hole on the second end of the center tube, (k) wherein the left cover would be placed over the left socket portion, and further wherein the right cover would be placed over the right socket portion, (l) means for removably securing the left cover to the left socket portion and the right cover to the right socket portion, and (m) means for altering the distance between the left socket portion and the right socket portion.

2. An adjustable socket ratchet according to claim 1 wherein the means for removably securing the left cover to the left socket portion and the right cover to the right socket portion further comprises a bolt, the bolt being inserted through the hole located approximately at the midpoint of the lower half of the left cover, the bolt further being inserted through the hole centrally located on the upper segment of the left socket portion, the bolt further being inserted through the hole centrally located on the upper segment of the left socket portion, the bolt further being threadably inserted through the hole located approximately at the midpoint of the lower half of the right cover.

3. An adjustable socket ratchet according to claim 1 wherein the means for altering the distance between the left socket portion and the right socket portion further comprises:

(a) a first adjustment knob fixedly attached to the first end of the threaded rod, the first adjustment knob being circular in shape, the adjustment knob having two sides, an inner side and an outer side, the first adjustment knob having a plurality of angled teeth attached to the perimeter of the inner side of the first adjustment knob, the angled teeth being attached at a forty-five (45) degree angle, (b) a second adjustment knob rotatably attached to the top of the upper section, the second adjustment knob being ring-shaped in nature, the second adjustment knob having two faces, an upper face and a lower face, the second adjustment knob having a plurality of angled teeth attached to the perimeter of the lower face of the second adjustment knob, the plurality of angled teeth being attached at a forty-five (45) degree angle, (c) wherein the plurality of angled teeth attached to the perimeter of the lower face of the second adjustment knob are interlocked with the plurality of angled teeth attached to the perimeter of the inner side of the first adjustment knob, and (d) further wherein rotating the second adjustment knob causes the first adjustment knob to rotate, further wherein the rotation of the first adjustment knob causes the threaded rod to rotate, and further wherein the rotation of the threaded rod causes the first socket portion and the second socket portion to either move away from each other or move toward each other.

* * * * *